United States Patent [19]

Velie et al.

[11] Patent Number: 5,017,129

[45] Date of Patent: May 21, 1991

[54] POROUS CERAMIC GAS BURNER

[75] Inventors: Wallace W. Velie, Alta Loma; William T. Lewis, San Dimas; Donald C. Haney, Rancho Cucamonga, all of Calif.

[73] Assignee: Scheu Manufacturing Company, Upland, Calif.

[21] Appl. No.: 475,964

[22] Filed: Feb. 6, 1990

[51] Int. Cl.[5] ..... F23D 3/40; F24C 3/04

[52] U.S. Cl. ..... 431/326; 431/328; 126/92 AC

[58] Field of Search ..... 431/326, 328, 329; 126/91 R, 92 AC, 92 C, 90 R; 239/555

[56] References Cited

U.S. PATENT DOCUMENTS

| | | | |
|---|---|---|---|
| 4,231,735 | 11/1980 | Downs | 431/328 |
| 4,746,286 | 5/1988 | Shirvill | 431/328 |
| 4,825,846 | 5/1989 | Fraioli | 126/92 AC X |
| 4,838,241 | 6/1989 | Rieger | 431/326 |
| 4,889,103 | 12/1989 | Fraioli | 126/92 AC |
| 4,917,599 | 4/1990 | Hasselmann | 431/326 X |

*Primary Examiner*—Larry Jones

*Attorney, Agent, or Firm*—Fleit, Jacobson, Cohn, Price, Holman & Stern

[57] ABSTRACT

A porous ceramic gas burner constructed from ceramic blocks associated with each other to form a hollow chamber to receive naturally aspirated gas and air mixture from a venturi with the ceramic blocks including a plurality of small holes enabling passage of the gas and air mixture to the outer periphery of the burner for ignition and combustion with the structural characteristics of the small holes preventing flashback of the flames even though the velocity of the air and gas mixture is less than the flame propagation rate thereby reducing the noise level of the burner by reducing the velocity of the air mixture passing through the burner. The burner is associated with a forced air heater including a fan and a duct associated therewith to direct forced secondary air over the periphery of the burner with the periphery of the burner including a surface generally parallel to the flow path of the secondary air and the holes in the burner being perpendicular to the flow path of the secondary air.

11 Claims, 2 Drawing Sheets

FIG. 3
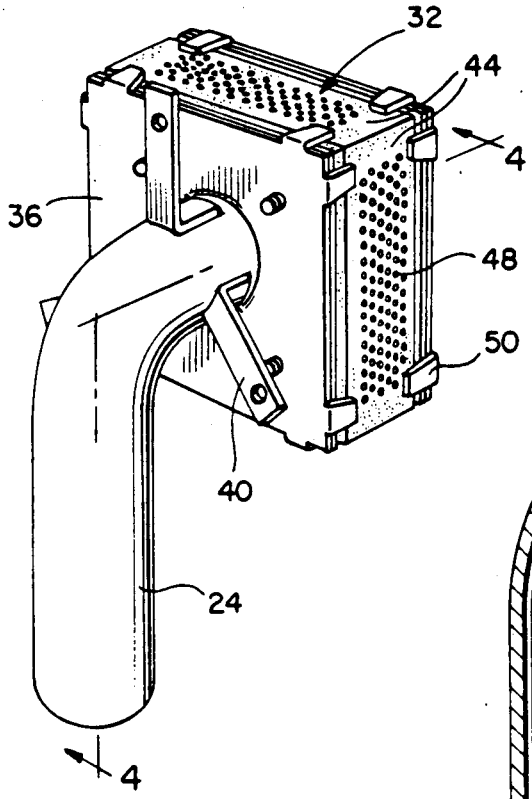
FIG. 4
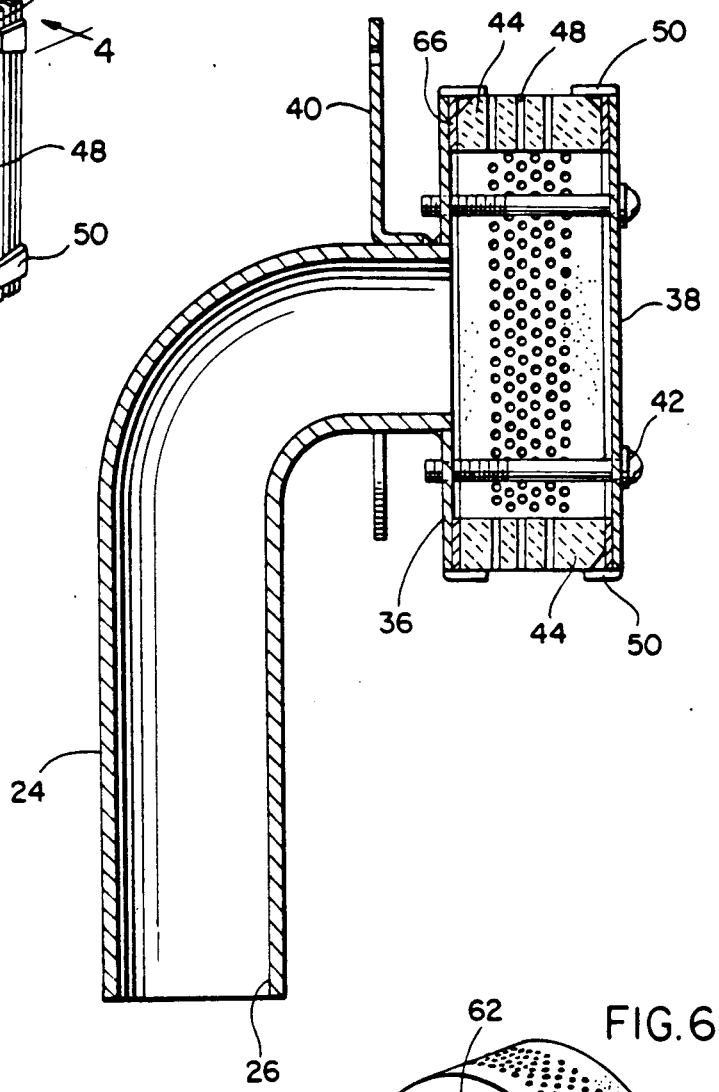
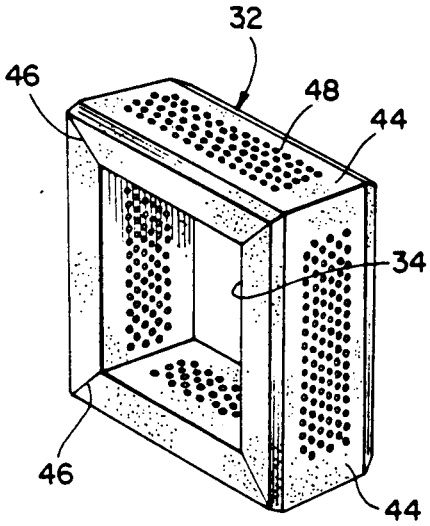
FIG. 5
FIG. 6
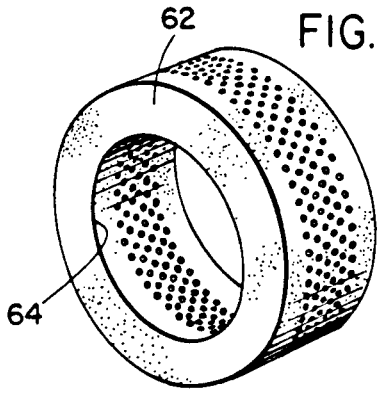

POROUS CERAMIC GAS BURNER

BACKGROUND OF THE INVENTION

1. Field of the Invention

The present invention generally relates to a quiet, compact and efficient burner for use with forced air heaters. More specifically, the invention relates to a porous ceramic gas burner constructed from ceramic blocks associated with each other to form a hollow chamber to receive naturally aspirated gas and air mixture from a venturi with the ceramic blocks including a plurality of small holes enabling passage of the gas and air mixture to the outer periphery of the burner for ignition and combustion with the structural characteristics of the small holes preventing flashback of flame even though the velocity of the air and gas mixture is less than the flame propagation rate thereby reducing the noise level of the burner by reducing the velocity of the air gas mixture passing through the burner. The burner is associated with a forced air heater including a fan and a duct associated therewith to direct forced secondary air over the periphery of the burner with the periphery of the burner including a surface generally parallel to the flow path of the secondary air with the holes in the burner being perpendicular to the flow path of the secondary air.

2. Information Disclosure Statement

Forced air heaters of various types are well-known and efforts have been made to provide such burners in a size that renders them portable. However, one of the problems which exists when reducing the size of a burner to render it feasible for use in a portable heater is the noise level produced by increased velocity of the air and gas mixture, increased flame speed and turbulence which is necessary in order to obtain desired heating capacity and efficiency. Usually, such burners introduce primary air in a manner that it mixes with the gaseous fuel before the mixture is burned which increases burning efficiency. This type of structure is relatively quiet as long as secondary combustion supporting air is naturally aspirated. However, the naturally aspirated secondary air burner is relatively large and not well suited for use in a portable forced air heater.

As a later development, portable forced air heaters have been provided with similar primary air burners which include forced secondary air which achieves good combustion performance with smaller size. However, along with the smaller size provided by the forced secondary air arrangement, the noise level of such burners increased substantially. An example of this type of forced air heater is found in U.S. Pat. No. 3,494,599 issued Feb. 10, 1970. While this type of heater is relatively efficient and provides sufficient heating capacity, the noise level is relatively high and is not compatible with adjacent personnel due to the noise level. The prior art in the field of portable forced air heaters does not disclose a burner structure that is sufficiently small or compact, efficient and provided with sufficient capacity for use with a portable forced air heater while maintaining noise at a sufficiently low level to enable its use with adjacent personnel.

SUMMARY OF THE INVENTION

An object of the present invention is to provide a porous ceramic gas burner for use with a portable forced air heater or the like which includes a porous ceramic burner having a porous ceramic peripheral wall defining a hollow interior cavity communicated with a source of mixed primary air and gaseous fuel at one side of the cavity with the other side of the cavity being closed by an endplate thereby requiring the primary air and gaseous fuel mixture to exit through the porous peripheral wall for combustion on and adjacent to the outer peripheral surface of the porous peripheral wall with forced secondary air flowing across the exterior surface and adjacent area of the peripheral wall in perpendicular relation to the path of flow of the air and gas mixture through the porous peripheral wall to provide secondary combustion air and convection circulation of heated air.

Another object of the invention is to provide a burner in accordance with the preceding object in which the peripheral ceramic wall is constructed of a plurality of segments to facilitate manufacture and assembly with the peripheral wall including a plurality of small holes extending from the inner cavity to the external periphery of the wall in which the holes are constructed in a manner to prevent flame flashback thus enabling the primary air and gaseous fuel mixture to pass through the holes at a low velocity less than the flame propagation rate thereby reducing the noise level of the burner.

A further object of the present invention is to provide a burner in accordance with the preceding objects in which the small holes in the ceramic peripheral wall are uniformly spaced and provide approximately a 40% flow area with the ceramic wall being approximately ½" thick and the hole diameter being approximately 0.050" in diameter.

Still another object of the invention is to provide a burner in accordance with the preceding objects which is efficient in operation, compact in size compared to the heating capacity of the burner and which produces a low noise level during operation thereby rendering the burner especially useful in a portable forced air heater.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a perspective view of the burner including the venturi, end plates and ceramic blocks.

FIG. 4 is a vertical, sectional view taken substantially upon a plane passing along section line 4—4 on FIG. 3 illustrating specific structural details of the burner.

FIG. 5 is a perspective view of the ceramic blocks assembled to form a square peripheral wall of the burner.

FIG. 6 is a perspective view similar to FIG. 5 but illustrating a ceramic wall of cylindrical configuration.

DESCRIPTION OF THE PREFERRED EMBODIMENT

Figure 1:
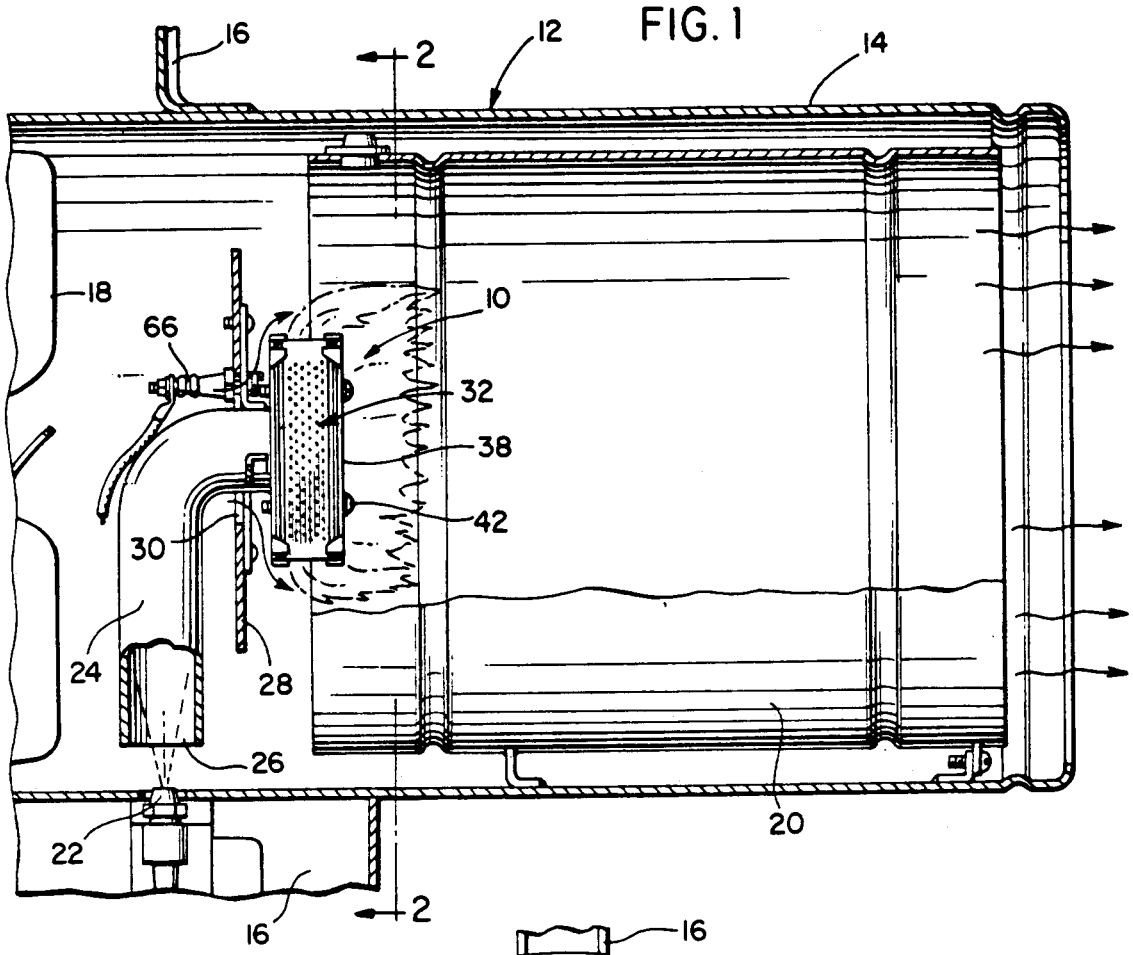
FIG. 1 is a sectional view of a portable, forced air heater with the burner of the present invention incorporated therein.

The porous, ceramic gas burner of the present invention is generally designated by reference numeral 10 and is illustrated in detail in FIGS. 3–6. The burner 10 of this invention is shown incorporated into a portable forced air heater generally designated by reference numeral 12 in FIGS. 1 and 2 which includes a housing 14 of cylindrical configuration provided with support structure 16. The interior of the housing 14 includes a fan 18 driven by an electric motor (not shown) with the housing 14 also including an open end 18 for discharging heat. This type of heater is well-known, except for burner 10, and is disclosed in detail in Pat. No. 3,494,599. As illustrated, a cylindrical liner 20 is supported in the housing 14 and a gaseous fuel nozzle 22 is associated with the inlet venturi tube 24 of the burner 10 in a manner to provide an entrance area 26 for primary air to be mixed with the gaseous fuel discharged from the nozzle 22 in a conventional manner with the burner and venturi 24 being supported by a bracket structure 28 in the form of a plate having a large central opening 30 providing a passageway for forced secondary air from the fan 18 over the burner 10 with suitable controls also being provided to control operation of the burner and fan in accordance with the above-mentioned patent.

The burner 10 of this invention includes a peripheral ceramic wall generally designated by reference numeral 32 which includes a hollow interior forming a cavity 34 that extends from one end to the other of the wall 32. One end of the cavity 34 is closed by a flat, imperforate inlet end plate 36 that is rigidly affixed to the end of the venturi as illustrated in FIGS. 3 and 4. The other end of the cavity 34 is closed by an imperforate end plate 38. As illustrated, the peripheral ceramic wall 32 is positioned between the plates 36 and 38 with the cavity 34 in communication with the interior of the venturi 24 to receive a mixture of gaseous fuel and primary air. The venturi 24 is supported by support tabs or brackets 40 connected with the bracket structure 28 and the end plate 38 is secured to the end plate 36 by a plurality of screw threaded fasteners 42 in the form of bolts or the like to retain the peripheral ceramic wall 32 in assembled relation to the end plates.

As illustrated in FIG. 5, the peripheral ceramic wall 32 is constructed from four identical, generally rectangular ceramic blocks 44 which include mitered ends 46 oriented at 45° angles to provide a square ceramic wall 32 with the cavity 34 being square and the plates 36 and 38 being correspondingly square. Each block includes a plurality of small holes 48 extending from the cavity 34 to the peripheral surface thereof and the end plates 36 and 38 include corner tabs 50 which engage the external surfaces of the blocks to retain them in assembled relation as illustrated in FIGS. 3 and 4. Each of the blocks 44 has a thickness of approximately ⅜" to ¾" with blocks of ½" thickness being a preferred dimension. The small holes 48 provide a flow area through the ceramic elements between 30% and 60% with the preferred porosity being 40%. The holes 48 are preferably cylindrical in configuration and are preferably 0.050" in diameter. The outside corner edges of the ceramic blocks may also be chamfered to facilitate handling and reduce sharp edges if desired. The ceramic peripheral wall 32 formed by the blocks 44 is of square configuration but, as illustrated in FIG. 6, it is also within the purview of the present invention to provide a ceramic peripheral wall 62 of cylindrical configuration with the cavity 64 also being cylindrical. The ceramic wall 62 may be segmental or of one-piece unitary construction. The unitary construction of a peripheral wall 32 or 62 is preferred but, from a manufacturing standpoint, the segmental peripheral wall may be more economical.

Figure 2:
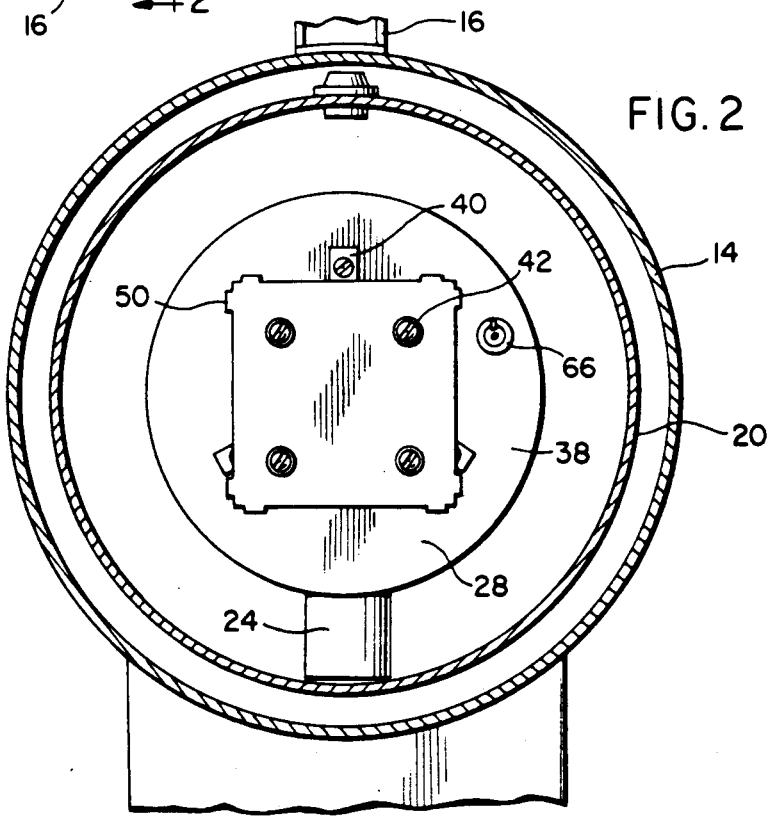
FIG. 2 is a transverse, sectional view taken substantially upon a plane passing along section line 2—2 on FIG. 1 illustrating the association of the burner with the other components of the forced air heater.

In use, the ceramic burner 10 as illustrated in FIG. 1 receives a mixture of primary air and gaseous fuel from the nozzle 22 which discharges gaseous fuel such as natural gas or propane into the inlet 26 of the venturi tube 24. The high velocity fuel entrains surrounding air molecules to provide naturally aspirated primary air into the venturi tube where it mixes with the gaseous fuel. The fuel and air mixture passes through the venturi tube 24 into the cavity or chamber 34 which is defined by the plate 36, plate 38 and the four porous ceramic blocks 44 or the ceramic wall 62. The porous ceramic blocks 44 form the periphery of the square burner with the small holes 48 providing a flow path for the mixture of fuel and primary air which exits into the combustion area around the periphery of the ceramic wall 32. Secondary air provided by the fan 18 is forced through the large hole 30 and over the periphery of the ceramic wall 32. The combustible mixture which is ignited by a suitable ignition device 66 encounters the secondary air for efficient combustion and to provide a heat source for the heater. When the fuel and air mixture is ignited and when the secondary air combines with the fuel and air mixture, the combustion is efficient thus providing a clean, compact and quiet burner due to the pervasive and uniform distribution of the relatively low velocity primary air and fuel mixture thereby resulting in a substantial reduction in combustion noise without a substantial change in heater efficiency, output or size. The structural characteristics of the ceramic peripheral wall are matched to the inlet characteristics of the nozzle and venturi tube which in turn are matched to the desired heater output. Thus, the burner size varies in accordance with the desired heat output and the structure of the ceramic peripheral wall including its thickness, hole size and porosity corresponds with the desired performance characteristics. The hole size and thickness is sufficient to prevent flashback of flame through the ceramic blocks thereby preventing any ignition or combustion in the venturi or cavity 34. The hole size is such that flashback is prevented by the flame being quenched which enables the velocity of the fuel and air mixture passing through the porous ceramic wall to be reduced below the flame propagation rate of the fuel and air mixture.

The end plates 36 and 38 are of metal construction and the ceramic blocks 44 are cushioned by a ceramic fiber mat 68 in the form of a strip which is positioned between the edges of the blocks 44 and the end plates 36 and 38, respectively, as illustrated in FIG. 4 to protect the fragile blocks from mechanical shock and also provide an insulation between the end edges of the blocks and the metal end plates 36 and 38. The fastener bolts 42 may be of any suitable construction and the number of bolts may vary depending upon the size characteristics of the burner.

The low velocity of the fuel and air mixture and its ignition and stabilization along the outer surface of the peripheral ceramic wall provides a less turbulent laminar flame around the periphery of the ceramic wall as compared to a relatively high velocity conventional burner. The lowered velocity of the primary air and fuel mixture provides lower shear forces and increases the flame front to encourage mixing with the secondary air. This also reduces the combustion sound level and the size and length of the small holes 48 prevents flashback by providing flow passages which will quench any flame trying to pass therethrough inasmuch as the surface area of the small holes is so great that it quenches or extinguishes the flame with the ceramic material having a low thermal conductivity so that it does not readily transfer heat from the hot combustion periphery of the ceramic wall to the relatively cold inlet side defining the periphery of the chamber or cavity 34.

The ceramic blocks or elements 44 are essentially rectangular blocks with the two ends beveled or chamfered at 45° with the blocks being retained in the square pattern by the end plates 36 and 38 with the tabs 50 on the end plates, the fasteners 42 and the ceramic fiber strips 68 cooperating to provide a quickly and easily assembled unit which is leak tight with the venturi being sized for the intended burn rate and compatible with the fuel nozzle 22. The fuel and air mixture passes through the venturi, which can be oriented in any desired relation to the housing, into cavity 34 and passes in a direction parallel to the end plates through the small holes to the peripheral surface of the peripheral ceramic wall with the mounting plate 28 also serving as a baffle or flame holder plate to provide a quiescent zone for flame stabilization and propagation on and along and adjacent the peripheral surface of the peripheral wall 32 which results in a very substantial reduction in noise level without a change in heater size or performance.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A burner for use in forced air heaters comprising a porous ceramic peripheral wall having an internal cavity, the peripheral wall being porous for transmitting a gaseous fuel and air mixture from the cavity to the external periphery of the ceramic wall, means supplying a gaseous fuel and air mixture to the cavity and means supply secondary air to the periphery of the ceramic wall with the movement of the fuel and air mixture through the peripheral wall being radial and in perpendicular relation to the flow of secondary air over the periphery of the ceramic wall, said ceramic peripheral wall including a plurality of small, uniformly spaced holes extending radially from the cavity to the periphery of the wall, said ceramic peripheral wall being constructed of a plurality of ceramic elements, and means retaining the ceramic elements in assembled relation to form a peripheral wall with a hollow cavity.

2. A forced air heater comprising a housing having a burner positioned therein, a fan in one end of said housing to move air through the housing, the other end of the housing being open to discharge heated air, said burner being positioned downstream of the fan such that forced secondary combustion supporting air from the fan passes over the periphery of the burner, said burner including a peripheral, porous ceramic wall having a central cavity communicated with a source of primary air and gaseous fuel with the ceramic wall including small holes rendering it porous with the small holes extending radially from the cavity to the periphery of the wall in a direction generally perpendicular to the flow path of secondary air over the periphery of the wall, said ceramic peripheral wall being constructed of a plurality of ceramic elements, and means retaining the ceramic elements in assembled relation to form a peripheral wall with a hollow cavity.

3. The forced air heater as defined in claim 2 wherein the length of the holes in the ceramic wall is approximately $\frac{3}{8}''$ to $\frac{3}{4}''$.

4. The forced air heater as defined in claim 3 wherein the length of the holes in the ceramic wall is approximately $\frac{1}{2}''$.

5. The forced air heater as defined in claim 2 wherein said ceramic elements include four ceramic blocks arranged in a square pattern.

6. The forced air heater as defined in claim 5 wherein the four ceramic blocks are of rectangular configuration with the ends thereof being chamfered at 45° to facilitate assembly and indexing of the blocks in a square pattern.

7. The forced air heater as defined in claim 2 wherein said means retaining the ceramic elements in assembled relation includes end plates sandwiching the ceramic wall and closing the cavity and fasteners extending through the end plates to retain them against the ends of the ceramic wall.

8. The forced air heater as defined in claim 2 wherein the porous ceramic peripheral wall is of circular configuration.

9. The forced air heater as defined in claim 2 wherein said means retaining the ceramic elements in assembled relation includes end plates engaging the ends of the ceramic elements with one end plate including means communicating with the cavity and supplying a primary air and gaseous fuel mixture thereto with the holes forming the porous ceramic wall extending from the cavity to the periphery thereof being parallel to the end plates.

10. The forced air heater as defined in claim 2 wherein said holes define a flow area ranging from 30% to 60% of the peripheral area of the peripheral wall.

11. The forced air heater as defined in claim 2 wherein said ceramic peripheral wall is approximately $\frac{1}{2}''$ thick with the small holes having a diameter of approximately 0.050" to quench any flame flashing back toward the cavity thereby enabling the velocity of the primary air and fuel mixture passing through the holes to be reduced below the flame propagation rate thereby enabling a substantial reduction in noise produced by the burner.

* * * * *